US006648465B2

(12) United States Patent
Gil et al.

(10) Patent No.: US 6,648,465 B2
(45) Date of Patent: Nov. 18, 2003

(54) HEATED MEDIA DEFLECTOR

(75) Inventors: Antoni Gil, Barcelona (ES); Enrique Luengo, Barcelona (ES); Sergio De Santiago, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/984,931

(22) Filed: Oct. 31, 2001

(65) Prior Publication Data

US 2003/0081097 A1 May 1, 2003

(51) Int. Cl.[7] ..... B41J 2/01
(52) U.S. Cl. ..... 347/102
(58) Field of Search ..... 347/101, 102, 347/104; 219/216; 400/605

(56) References Cited

U.S. PATENT DOCUMENTS 4,417,825 A * 11/1983 Cushman et al. ..... 400/605
5,751,303 A * 5/1998 Erickson et al. ..... 347/16
5,761,597 A * 6/1998 Smith et al. ..... 399/339
5,951,181 A 9/1999 Hierro et al. ..... 400/645
6,132,038 A * 10/2000 Szlucha ..... 347/102
6,231,176 B1 * 5/2001 Peter ..... 347/102

* cited by examiner

*Primary Examiner*—Stephen D. Meier
*Assistant Examiner*—An H. Do

(57) ABSTRACT

A heated media deflector for an inkjet printer. The media deflector is located in a transition area between a horizontal printing plane and a vertical feeding path. The media deflector includes a plastic support portion and a sheet metal portion with a heating resistor attached to a bottom surface of the sheet metal portion. The sheet metal portion provides a guiding surface for guiding a media from a printing zone to the vertical feeding path. The sheet metal portion of the heated media deflector also radiates heat that dries excess water absorbed by the media during printing. The inkjet printer includes a controller for controlling the heating temperature of the heated media deflector. The heating temperature is set based on environmental conditions and print job parameters.

16 Claims, 6 Drawing Sheets

HEATED MEDIA DEFLECTOR

FIELD OF THE INVENTION

This invention relates generally to inkjet printers and more particularly to an inkjet printer including an arrangement to prevent paper distortion resulting from wet ink absorption.

BACKGROUND OF THE INVENTION

It is generally known to use inkjet printers to print on paper-based products. The inkjet printer produces ink drops that are deposited onto the paper product to produce the finished printed product. A printhead including at least one ink cartridge containing nozzles producing the ink drops. The ink cartridge containing nozzles is moved repeatedly across the width of the paper. At each of a designated number of increments of this movement across the paper, each of the nozzles is caused either to eject ink, or to refrain from ejecting ink according to the program output of the controlling microprocessor. Each completed movement across the paper can print a swath approximately as wide as the number of nozzles arranged in a column on the ink cartridge multiplied by the distance between nozzle centers. After each such completed movement or swath, the paper is advanced forward by approximately the width of the swath, and the ink cartridge begins the next swath. By proper selection and timing of signals output by the controller, the desired print is obtained on the paper. In order to obtain multicolored printing, a plurality of ink-jet cartridges, each having a chamber holding a different color of ink from the other cartridges, may be supported on the printhead.

One problem associated with inkjet printers is that water-based inks have a tendency to produce prints of a less than desirable quality. Typically, ink-jet printers are not able to print high density plots on paper-based media without suffering two major drawbacks: the saturated media is transformed into an unacceptably wavy or cockled sheet; and adjacent colors tend to run or bleed into one another. When the water-based ink is deposited on paper-based media, it absorbs into the cellulose fibers and causes the fibers to swell. As the cellulose fibers swell, they generate localized expansions that cause the paper to deform uncontrollably in these regions. This phenomenon is called paper cockle. This can cause a degradation of print quality due to uncontrolled pen-to-paper spacing, and can also cause the printed output to have a low quality appearance due to the wrinkled media.

Paper cockle may include lateral deformation. Lateral deformation is especially troublesome when printing on paper-based media that is printed in a horizontal plane and thereafter transported in a vertical plane. The lateral deformation is not instantaneous, because the water content takes some time to be absorbed into the media. The absorbing process takes place while the media travels from the horizontal printing plane and continues while the media travels in the vertical plane. The deformation makes the paper grow, and it grows with time, which means that the bottom part of the media is wider than the top part of the media. Therefore, the lateral expansion produces webs that are trapezoidal in shape as opposed to a normal rectangular shape. The paper-based web may sag or "smile" as it moves downwards, making it difficult to carry out further media processing. This problem occurs in inkjet printing machines, such as plotters, because plotters typically transport paper-based webs from a horizontal printing plane to a vertical exit plane.

The FIGS. 1A and 1B show an exemplary illustration of an inkjet printer 10 that may experience lateral expansion and paper cockle in general. The printer 10 may be a web fed inkjet printer 10 such as a plotter on a stand with legs 12. FIG. 1B is a cross sectional view and it shows a supply roll 20 on which is wound a paper-based web 11. The web is transported to the printhead 30 where it is printed upon while in a horizontal orientation. From the printhead, the web 11 is then transported in a vertical orientation. As illustrated in FIG. 1B, the web 11 falls out of the printer 10 through an exit 40 while maintaining the vertical orientation.

Prior art solutions to media deformation include the use of media deflectors as disclosed in U.S. Pat. No. 5,951,181. The deflectors taught in '181 are not heated. As result, the deflectors do not effectively prevent media expansion.

The prior art also discloses the use of heating elements positioned downstream of the printing area. These heating elements usually include a line of fans blowing warm air onto the media surface. Typically, these devices dry the ink on the media surface, so that media can be retrieved or rolled onto a take-up reel at a more efficient rate. However, these devices are not very efficient for controlling media deformations caused by ink expanding the paper fiber because they are not efficient at drying ink that is absorbed into the cellulose fibers.

SUMMARY OF THE INVENTION

In one respect, the invention is a printing apparatus for reducing the lateral expansion of a printing media. The printing apparatus includes a printing zone for printing in a substantially horizontal orientation. The printing apparatus also includes a heated media deflector configured to guide and dry the media. The heated media deflector is located downstream of the horizontal printing zone.

In another respect, the invention is a method of reducing lateral expansion in media during an inkjet printing process in which the media travels from a substantially horizontal printing plane to a substantially vertical feeding path. The method includes the step of printing an image on the media. The image is printed in the substantially horizontal printing plane. The method also includes the step of feeding the media in the substantially vertical feeding path after printing the image. In this respect, the method also includes the step of heating the media by passing it over a heated media deflector. The heated media deflector is located in a transition area between the substantially horizontal printing plane and the substantially vertical feeding path.

In yet another respect, the invention is a method of reducing the lateral expansion of media in inkjet printers. The method includes the steps of detecting environmental conditions and determining print mode parameters. In this respect, the method of reducing the lateral expansion of media includes the step of setting a heating temperature for heating the media. The heating temperature is set based on the detected environmental conditions and the determined print mode parameters.

In another respect, the invention is a heated media deflector for an inkjet printer. The heated media deflector includes a plastic support portion. In this respect, the deflector also includes a sheet metal portion attached to the plastic portion. The heated media deflector also includes a heating resistor attached to a bottom face of the sheet metal.

In comparison to known prior art, certain embodiments of the invention are capable of achieving certain aspects, including a reduction in media deformation and an improvement in image quality. Those skilled in the art will appreciate these and other aspects of various embodiments of the invention upon reading the following detailed description of a preferred embodiment with reference to the below-listed drawings.

DETAILED DESCRIPTION OF A PREFERRED EMBODIMENT

The invention is directed towards a heated media deflector for an inkjet printer. As explained herein below, the heated media deflector is located in a printer between a printing station and a printer exit. The heated media deflector provides guiding surfaces on which a media travels as it leaves the printing station and heads towards the printer exit. The heated media deflector also radiates heat that is absorbed by the media.

Figure 1A:
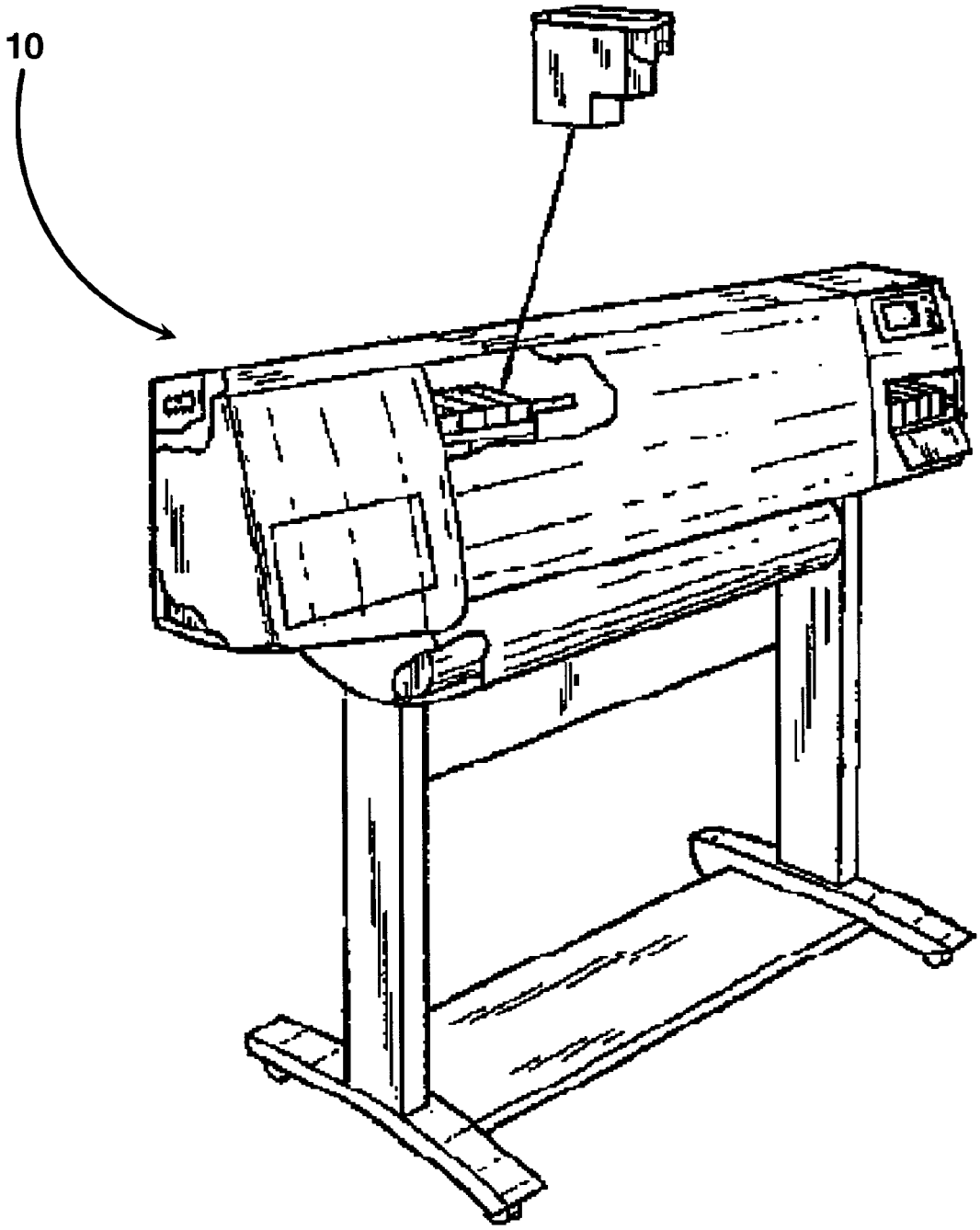
FIG. 1A PRIOR ART
FIGS. 1A and 1B are exemplary illustrations of a prior art inkjet printer.
Figure 1B:
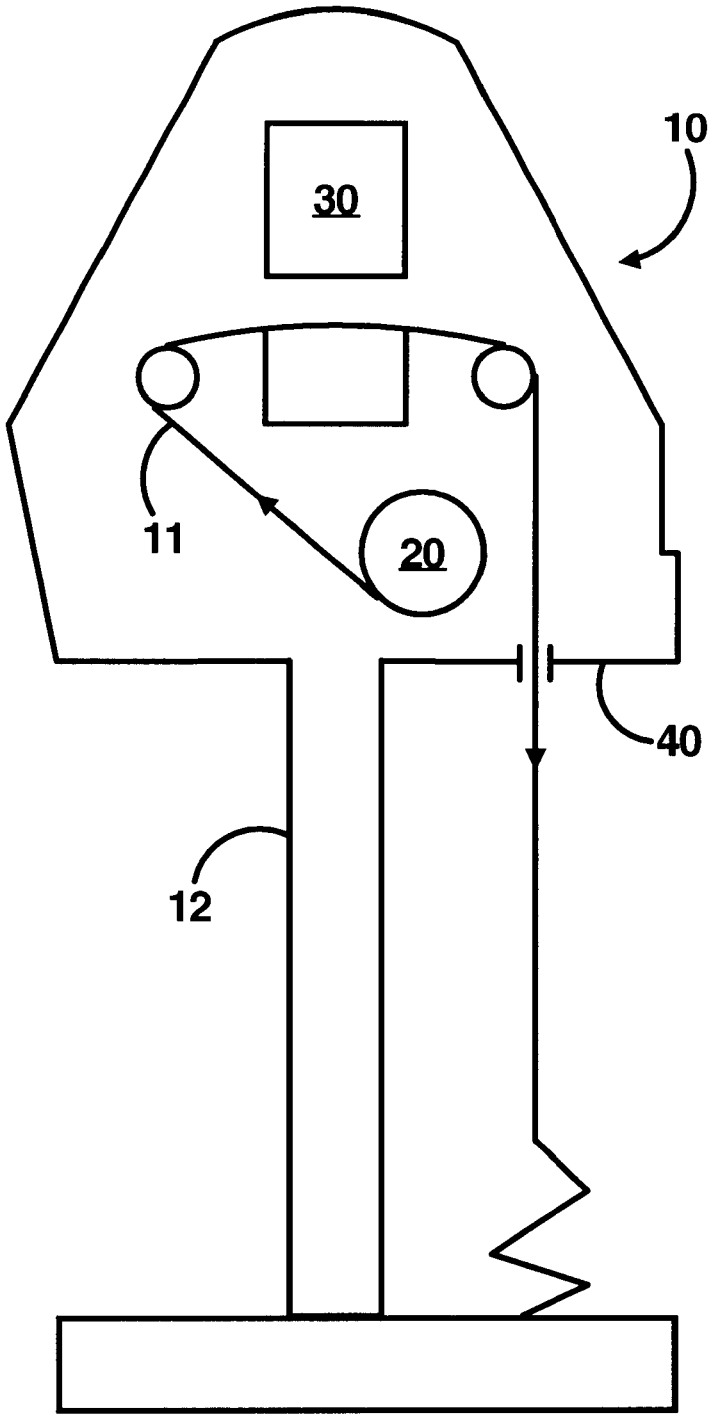
FIG. 1B PRIOR ART
Figure 2A:
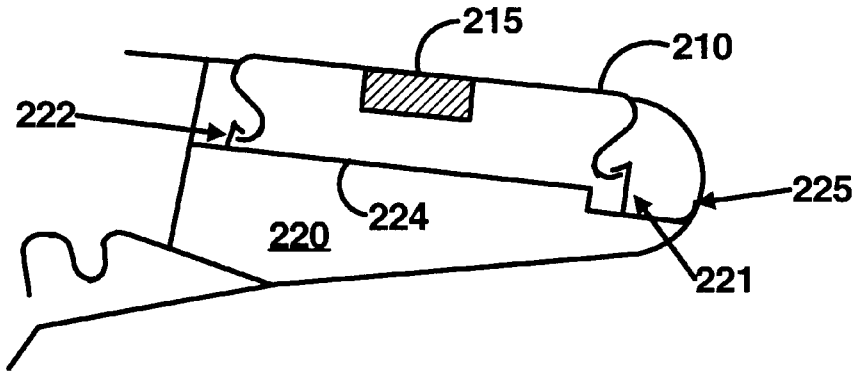
FIG. 2A is an exemplary illustration of a heated media deflector according to the invention.

FIG. 2A is an exemplary illustration of a heated media deflector 200 according to the invention. As illustrated, the heated media deflector 200 includes two sections, a sheet metal portion 210 and a plastic support portion 220. The plastic support portion 220 is attached to the printer frame (not shown). The plastic support portion 220 has two lateral hooks 221 and 222. The hooks 221 and 222 are provided on an insulating plank 224 that is a part of the plastic support portion 220. The plastic support section also includes a curved plastic extrusion 225 providing a smooth surface for directing media in a vertical direction.

As illustrated in FIG. 2A, the sheet metal portion 210 is attached to the plastic support portion 220 via the lateral hooks 221 and 222. However, other types of conventional connections may be used. Strips of insulator (not shown) may be provided at the contact points between the lateral hooks and the sheet metal portion 210. As illustrated, the sheet metal 210 is attached so that it is at a slight angle relative to the horizontal. Preferably, the sheet metal 210 is at an angle of about 10 degrees below the horizontal, so that the sheet metal 210 slopes downwards. The sheet metal portion 210 may be stainless steel, painted steel, and the like. A heating resistor 215 is provided at a bottom face of the sheet metal portion 210. The heating resistor 215 may be a flex circuit and may be attached to the sheet metal 210 with an adhesive. The heating resistor 215 is used to regulate the temperature of the sheet metal portion 210 of the heated media deflector 200. Preferably, the heating resistor 215 heats the sheet metal 210 from approximately 50° C. to 70° C. so that it is not a hazard to anyone touching it. The insulating plank 224 helps to direct any escaping heat back towards the sheet metal portion 210.

Figure 2B:
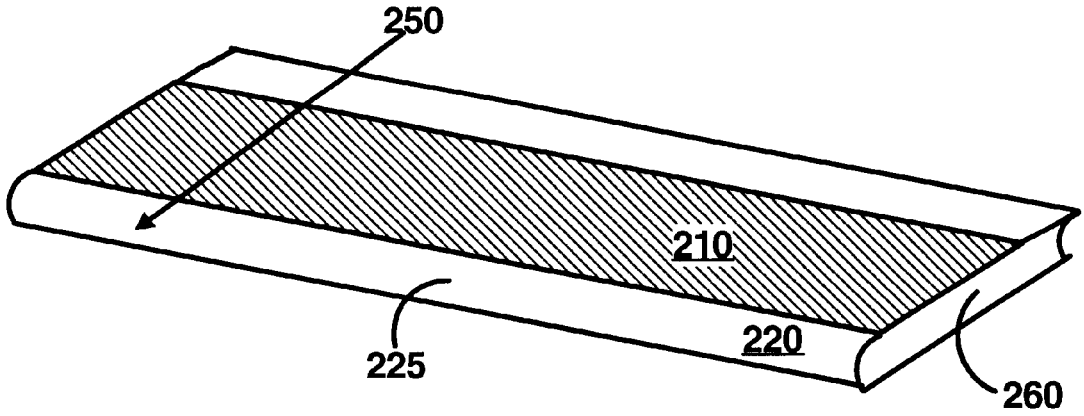
FIG. 2B is an exemplary perspective view of the heated media deflector.

FIG. 2B is an exemplary perspective view of heated media deflector 200. FIG. 2B illustrates the rectangular shape of the sheet metal portion 210. Arrow 250 represents the feeding direction, i.e., the direction media is fed with respect to the heated media deflector 200. The sheet metal portion 210 may span the width of the printer, preferably 40–60 inches wide. The length of the sheet metal portion 210 in the feeding direction 250 may be about 4 inches. FIG. 2B also shows one of two end caps 260. The end caps 260 are provided at the ends of the heated media deflector 200 and prevent heat loss from the arrangement.

Figure 3:
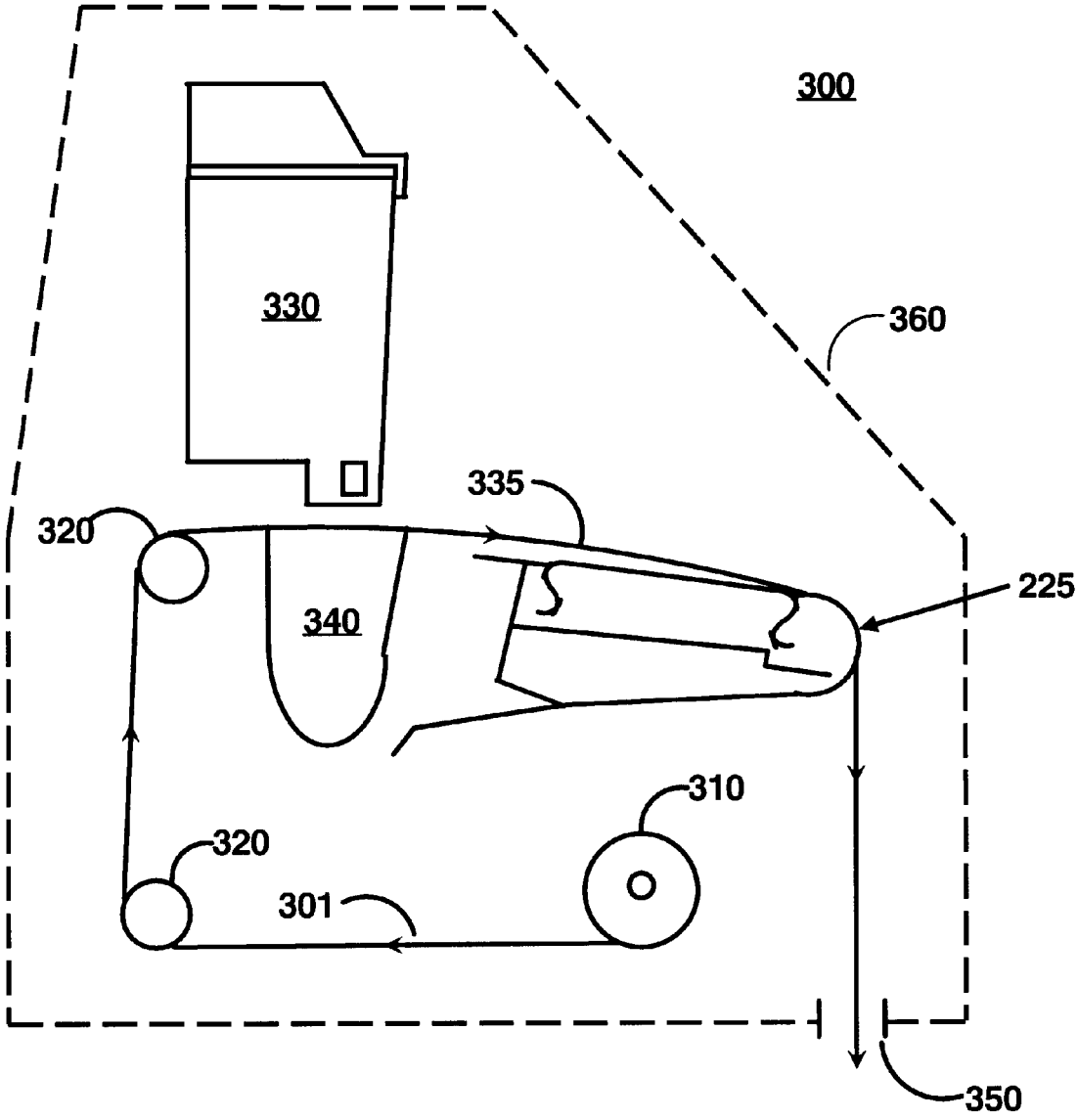
FIG. 3 is an exemplary cross section of an inkjet printer, including the heated media deflector according to the invention.

FIG. 3 is an exemplary cross section of an inkjet printer 300 including the heated media deflector 200. FIG. 3 shows a paper-based media web 301 as it travels a media path through the inkjet printer 300. The web 301 is wound on a supply reel 310 and is fed from the supply reel 310 to a printing zone 335 via a series of feed rollers 320. The feeding roller 320 may be powered by known power means.

The printing zone 335 is arranged for printing in a substantially horizontal orientation. The printing zone 335 includes a printhead arrangement 330 and a platen 340. The printhead arrangement 330 may contain a plurality of printhead cartridges, each printhead including an array of nozzles for ejecting ink drops onto the paper-based web 301. The printhead arrangement 330 may be supported on a carriage rod (not shown) to define a scanning axis, along which the printhead arrangement travels back and forth reciprocally across the printing zone. The platen 340 provides support for the web 301 during the printing process. As illustrated, the web 301 is positioned in a substantially horizontal orientation defining a horizontal printing plane, for receiving the ink drops (images). Upon the completion of printing an image, the carriage (not shown) may be used to drag a cutting mechanism across a trailing portion of the web 301 to sever the image from the remainder of the roll.

After the web 301 leaves the printing zone it contacts and is guided by the surface of the sheet metal portion 210 of the heated media deflector 200. As outlined above, the sheet metal portion 210 may slope at an angle of about 10 degrees below the horizontal. This downward sloping surface provides a smooth transition feeding area between the substantially horizontal printing plane and a substantially vertical feeding path 345. FIG. 3 also shows the curved plastic extrusion 225 for directing the web 301 in the vertical feeding path. The substantially vertical feeding path leads the web 301 through the printer exit 350. As illustrated, the web 301 drops out or hangs out of the printer 300 at exit 350. A collection bin may be placed at the exit 350 to prevent the web 301 from falling on the floor. As outlined above, the web 301 may be cut before it is collected in the bin. Alternatively, the web 301 may be collected and rolled onto a take-up spool or the like.

In addition to providing a smooth guiding surface, the heated media deflector 200 also radiates heat that is absorbed by the web 301. As outlined above, the sheet metal portion 210 includes heating resistors 215 for providing heat to the web 301. As the web passes over the sheet metal portion 210, excess water from the water-based ink is evaporated. Typically, as the web 301 travels from the horizontal printing plane to the vertical feeding path 245, excess water is absorbed causing media deformation such as the lateral deformation. Typically, the longer the web 301 travels in the vertical feeding path 245, the more lateral deformation that occurs. The heated media deflector 200 increases the amount of excess water that is evaporated. By evaporating excess water, the heated media deflector 200 substantially prevents lateral and other media deformation.

The process of drying excess ink from the web 301 during a printing process, using an inkjet printer 300 as illustrated in FIG. 3, is summarized herein. First, an image is printed on the web 301. The printing takes place in a substantially horizontal plane. Following the printing, the web 301 is heated for drying excess ink. The heated media deflector 200 dries the excess ink. The drying takes place when the web 301 is fed over the sheet metal portion 210 of the heated media deflector 200. Next, the web 301 is fed in a substantially vertical feeding path where it exits the printer.

Figure 4:
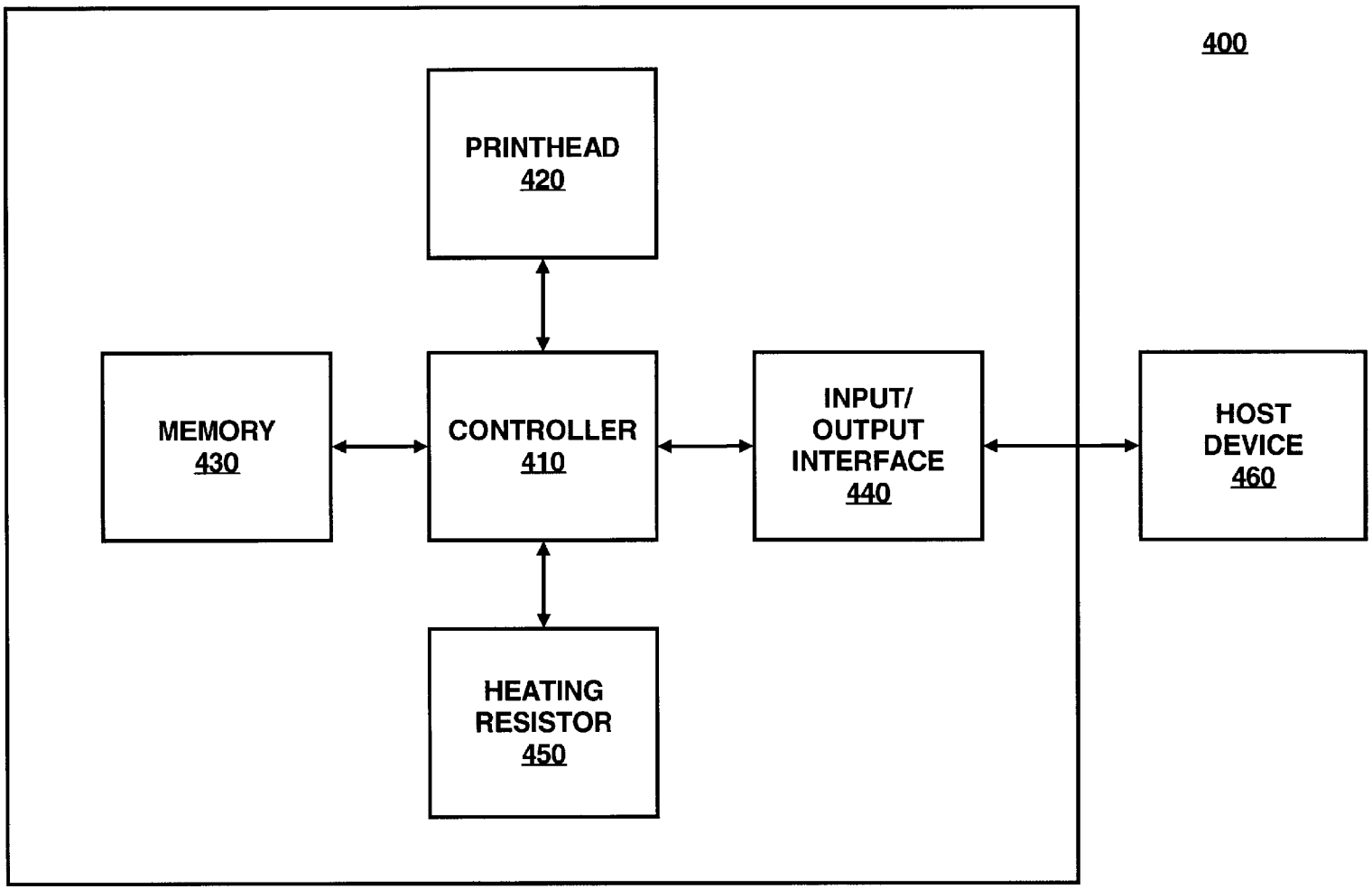
FIG. 4 is an exemplary block diagram of elements of an inkjet printer according to the invention.

FIG. 4 is an exemplary block diagram of elements of a printer 400 in accordance with the principles of the present invention. As will become better understood from a reading of the present disclosure, the following description of the block diagram of FIG. 4 illustrates one manner in which an inkjet printer 400 may be operated. In this respect, it is to be understood that the following description is but one manner of a variety of different manners in which such an inkjet printer may be operated.

FIG. 4 illustrates a controller 410, a printhead 420, a memory 430, an input/output interface 440, a heating resistor 450, and a host device 460. The controller 410 may be configured to provide control logic for the printer 400, which provides the functionality for the printer. In this respect, the controller 410 may possess a microprocessor, a microcontroller, an application specific integrated circuit, or the like. The controller 410 may also include circuits to control the operation of the print head 420 and other voltage receiving components (not shown).

The printhead 420 is configured to repeatedly pass across a substrate in individual, horizontal swaths or passes during a printing operation to print images/patterns onto the media. As stated above, the controller 410 controls the operation of the printhead 420. This includes the operation of printhead components such as ink cartridges and nozzles, carriage belt and pulley systems and the like. Printhead circuitry provides the controller 410 with feedback relating to the variables such as the type of ink and the amount of ink.

The controller 410 may be interfaced with a memory 430 configured to provide storage of computer software, firmware or hardware that provides the functionality of the printer 400 and may be executed by the controller 410. The memory 430 may be configured to provide a temporary storage area for data/file received by the printer 400 from the host device 460, which is typically a computer, server, workstation, or the like. The memory 430 may be implemented as a combination of volatile and non-volatile memory, such as dynamic random access memory ("RAM"), EEPROM, flash memory, and the like.

As illustrated in FIG. 4, the controller 410 is interfaced with the heating resistor 450. The heating resistor 450 is used to provide heat to the heated media deflector as illustrated in FIG. 2. A temperature sensor (not shown) may be attached to the heating resistor 450 to provide feedback to the controller 410 about the thermal status of the heating resistor.

The controller 410 is further interfaced with an I/O interface 440 configured to provide a communication channel between a host device 460 and the printer 400. The I/O interface may conform to protocols such as RS-232, parallel, small computer system interface, universal serial bus, etc.

In operation, the host device 460 sends print job information to the controller 410. The controller 410 may include formatting circuitry that formats the print job information. According to the print job information, the controller 410 sets the print mode parameters. The print mode parameters may include variables such as, plot width, the amount of ink fired per scan, printhead scanning rate, and web advance rate. Print mode parameters such as media type and ink type may be automatically or manually set. The controller 410 also sets a heating temperature of the heating resistor 450.

The heating temperature of the heating resistor may be based on environmental conditions and the print mode parameters. The environmental conditions include variables such as ambient temperature and humidity. Sensors (not shown) may be provided in the printer to sense the environmental conditions such as temperature and humidity. The environmental conditions such as temperature and humidity are important because these values affect the rate at which ink is absorbed by the substrate. Therefore, the controller 410 may evaluate the environmental conditions in order to set a proper heating temperature for the heating resistor.

In a similar manner, the print mode parameters may determine the temperature at which the heating resistor is set. For instance, depending on the width of a plot, it would take the printhead more time or less time to scan from side to side to produce the desired image. A wider plot would take more time to print and a narrower plot would take less time to print. If it takes more time to print, then it takes more time for the substrate to go past the heater, and overheating of the substrate may be a problem. If it takes less time to print, then it takes less time for the substrate to go past the heater, and under-heating of the substrate may be a problem. Therefore, the controller 410 may evaluate the different print mode parameters in order to set a proper heating temperature. Essentially, both print mode parameters and environmental conditions may be evaluated in order to set the heating temperature of the heating resistor.

Figure 5:
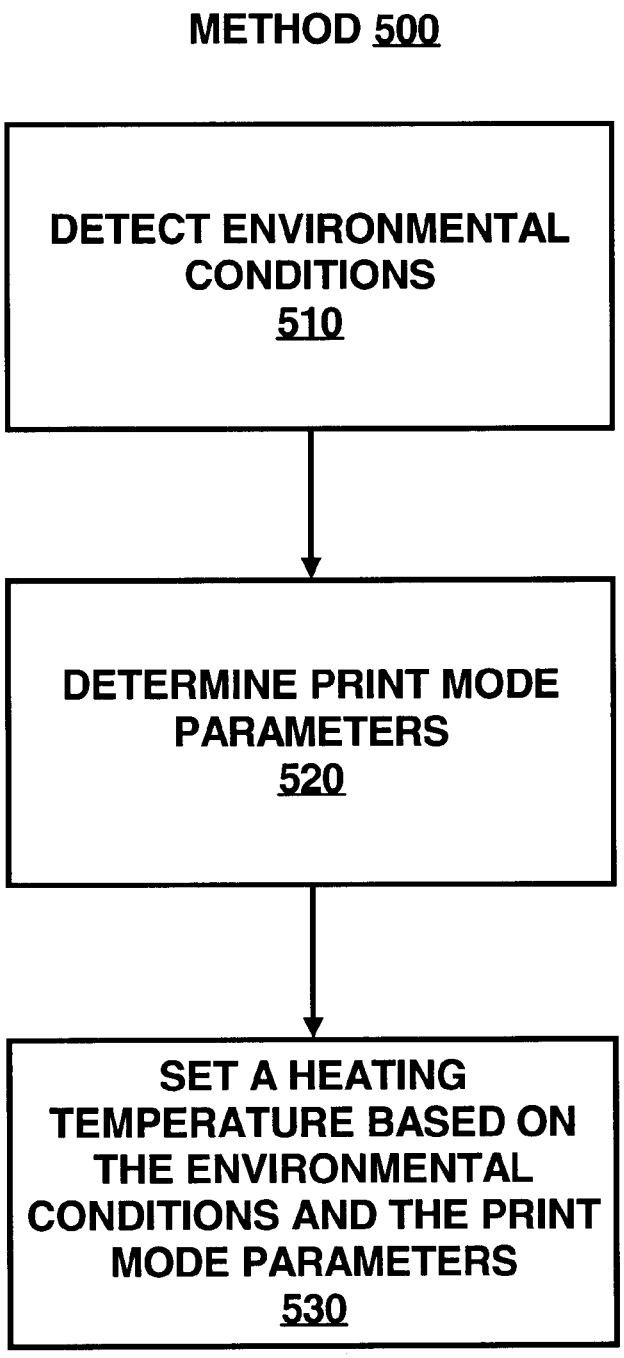
FIG. 5 is a flowchart of a method of reducing distortion in a printer according to the invention.

FIG. 5 is a flowchart of a method 500 of reducing distortion in the printer 400. Step 510 is the step of detecting environmental conditions. As outlined above, sensors (not shown) may be provided in the printer to sense the environmental conditions such as temperature and humidity. The method 500 also includes step 520, i.e., determining print mode parameters. As outlined above, the controller 410 determines the print mode parameters that include variables such as, plot width, the amount of ink fired per scan, printhead scanning rate, web advance rate, media type, and ink type. In step 530, the temperature is set for heating the media. The temperature is set based on the detected environmental conditions and the controller determined print mode parameters. Preferably, the heating temperature is approximately 50° C. to 70° C.

What has been described and illustrated herein is a preferred embodiment of the invention along with some of its variations. The terms, descriptions and figures used herein are set forth by way of illustration only and are not meant as limitations. For instance, the heated media deflector may be implemented in inkjet printers other than plotters. The width of the deflector may vary depending on the size of the printer. Those skilled in the art will recognize that many variations are possible within the spirit and scope of the invention, which is intended to be defined by the following claims and their equivalents in which all terms are meant in their broadest reasonable sense unless otherwise indicated.

What is claimed is:

1. A printing apparatus comprising:

a printing zone for printing in a substantially horizontal orientation;

a heated media deflector configured to guide the media, the heated media deflector located downstream of horizontal printing zone; and a substantially vertical feeding path downstream of the heated media deflector wherein the heated media deflector is a transition feeding area between the horizontal printing zone and the vertical path.

2. The apparatus of claim 1, wherein the heated media deflector comprises:

a plastic support portion; and a sheet metal portion attached to the plastic support portion, the sheet metal portion configured to contact and guide the media.

3. The apparatus of claim 2, wherein the sheet metal portion slopes downwards at about 10° below the horizontal.

4. The apparatus of claim 3, further comprising a heating resistor heating the sheet metal to dry the media, the beating resistor being attached to a bottom face of the sheet metal portion.

5. The apparatus of claim 4, wherein the plastic support portion comprises a plastic extrusion for directing the media into the vertical feeding path.

6. The apparatus of claim 4, wherein the plastic support portion comprises an insulating plank preventing heat loss.

7. The apparatus of claim 6, further comprising a pair of lateral hooks on the insulated plank attaching the sheet metal portion to the plastic support portion.

8. The apparatus of claim 7 wherein the vertical feeding path includes an exit where the media exits the printing apparatus.

9. The apparatus of claim 4, wherein the printing zone comprises a printhead arrangement printing on the media and a platen for supporting the media during printing.

10. A method of reducing distortion in media during an inkjet printing process when the media travels from a substantially horizontal printing plane to a substantially vertical feeding path, the method comprising:

printing an image an the media in the substantially horizontal printing plane;

feeding the media in the substantially vertical feeding path alter printing the image; and heating the media by passing it over a heated media deflector in a transition area between the substantially horizontal printing plane and the substantially vertical feeding path.

11. The method of claim 10, wherein the step of printing comprises printing water-based ink from an inkjet printhead and providing a paper-based web media.

12. The method of claim 11, wherein the step of heating the media comprises producing an amount of heat to evaporate excess water from the water-based ink.

13. A heated media deflector for an inkjet printer comprising:

a plastic support portion;

a sheet metal portion attached to the plastic portion;

a heating resistor attached to a bottom face of the sheet metal; and wherein the sheet metal portion slopes downwards at about 10° below the horizontal.

14. The apparatus of claim 13, wherein the plastic support portion comprises a plastic extrusion for smoothly directing a media to a vertical feeding path.

15. The apparatus of claim 14, wherein the plastic support portion comprises an insulating plank for preventing heat loss.

16. The apparatus of claim 15, further comprising a pair of lateral hooks on the insulated plank for attaching the sheet metal portion to the plastic support portion.

* * * * *

UNITED STATES PATENT AND TRADEMARK OFFICE

CERTIFICATE OF CORRECTION

PATENT NO. : 6,648,465 B2
DATED : November 18, 2003
INVENTOR(S) : Gil et al.

It is certified that error appears in the above-identified patent and that said Letters Patent is hereby corrected as shown below:

Column 6,
Line 59, insert -- and dry -- between “guide” and “the”.
Line 60, insert -- the -- between “of” and “horizontal”

Column 7,
Line 8, replace “beating” with -- heating --.
Line 29, replace “an” with -- on --.
Line 32, replace “alter” with -- after --.

Signed and Sealed this

Sixth Day of April, 2004

JON W. DUDAS
*Acting Director of the United States Patent and Trademark Office*